US005953788A

United States Patent [19]

Douglas

[11] Patent Number: 5,953,788

[45] Date of Patent: Sep. 21, 1999

[54] ELECTRIC DUST PAN

[76] Inventor: Stephen W. Douglas, 607 N. 4th, Bardstown, Ky. 40004

[21] Appl. No.: 09/048,414

[22] Filed: Mar. 26, 1998

[51] Int. Cl.[6] ..... A47C 5/28

[52] U.S. Cl. ..... 15/339; 15/310; 15/350

[58] Field of Search ..... 15/301, 310, 339, 15/350, 314

[56] References Cited

U.S. PATENT DOCUMENTS

| | | | |
|---|---|---|---|
| 1,898,887 | 2/1933 | Naul | 15/310 X |
| 3,056,993 | 10/1962 | Lewis | 15/310 |
| 3,088,484 | 5/1963 | Marsh . | |
| 3,353,996 | 11/1967 | Hamrick . | |
| 4,363,674 | 12/1982 | Fullenwider . | |
| 4,551,879 | 11/1985 | Ray | 15/314 X |
| 4,766,637 | 8/1988 | Winnicki . | |
| 4,907,316 | 3/1990 | Kurz | 15/319 X |
| 4,977,638 | 12/1990 | Best . | |
| 5,205,013 | 4/1993 | Lopes | 15/310 X |
| 5,279,016 | 1/1994 | Klassen . | |
| 5,432,976 | 7/1995 | Alazet | 15/350 X |
| 5,504,967 | 4/1996 | Graham | 15/314 X |
| 5,617,610 | 4/1997 | Dearaujo | 15/350 X |

*Primary Examiner*—Chris K. Moore
*Attorney, Agent, or Firm*—Hebderson & Sturm

[57] ABSTRACT

An electric dust pan having a housing with a forwardly extending lower section. The lower section includes an inlet opening and an upwardly and forwardly inclined bottom surface terminating at the inlet opening. An electric vacuum source is activated by a mercury switch when the housing is tilted forward from the upright position so that the inclined bottom surface contacts a floor surface. The inlet opening communicates with the suction side of the vacuum source and a dust bag held in the housing communicates with the discharge side of the vacuum source. A hinged top cover provides access to the dust bag and a handle of the top cover can be gripped by the user to move the housing from the upright position to the forward tilted position.

6 Claims, 1 Drawing Sheet

ELECTRIC DUST PAN

BACKGROUND OF THE INVENTION

1. Field of the Invention

The present invention relates to the field of vacuum cleaning equipment, and more particularly to an electric dust pan.

2. Description of Related Art

As can be seen by reference to the following U.S. Pat. Nos. 3,088,484; 3,353,996; 4,363,674; 4,766,637; 4,977,638; and 5,279,016, the prior art is replete with myriad and diverse vacuum cleaning devices.

While all of the aforementioned prior art constructions are more than adequate for the basic purpose and function for which they have been specifically designed, they are uniformly deficient with respect to their failure to provide a simple, efficient, and practical electric dust pan.

As a consequence of the foregoing situation, there has existed a longstanding need for a new and improved electric dust pan and the provision of such a construction is a stated objective of the present invention.

BRIEF SUMMARY OF THE INVENTION

Briefly stated, the present invention includes an electric dust pan having a housing with a forwardly extending lower section. The lower section includes an inlet opening and an upwardly and forwardly inclined bottom surface terminating at the inlet opening. An electric vacuum source is activated by a mercury switch when the housing is tilted forward from the upright position so that the inclined bottom surface contacts a floor surface. The inlet opening communicates with the suction side of the vacuum source and a dust bag held in the housing communicates with the discharge side of the vacuum source. A hinged top cover provides access to the dust bag and a handle of the top cover can be gripped by the user to move the housing from the upright position to the forward tilted position.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
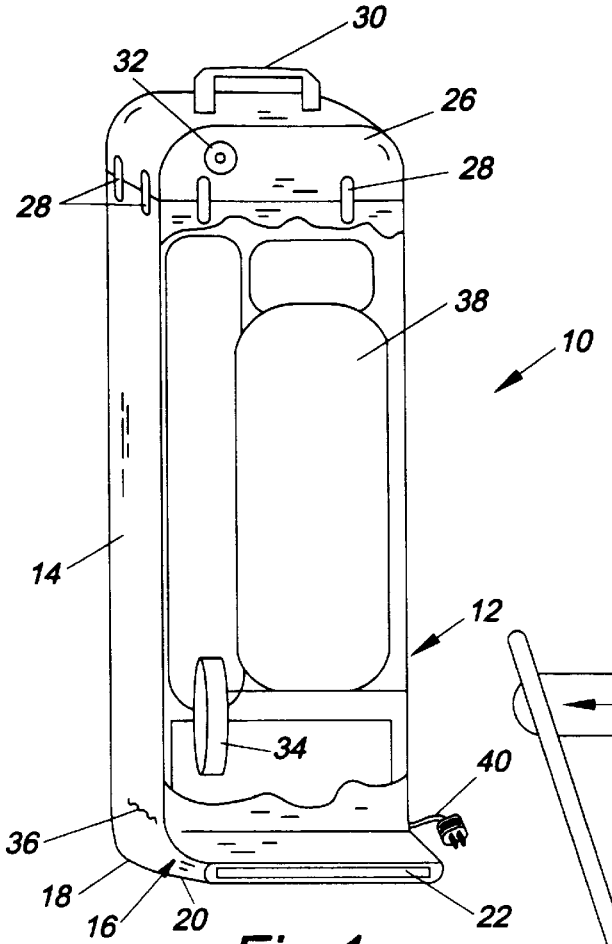
FIG. 1 is a front perspective view of the electric dust pan of the present invention with a front portion of the housing cut away.
Figure 2:
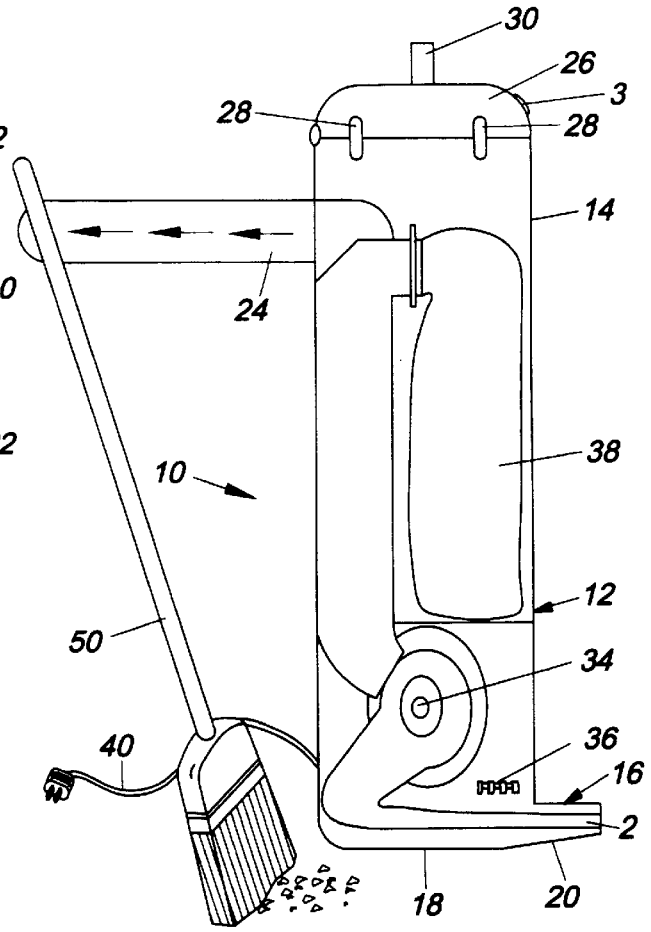
FIG. 2 is a side elevation sectional view of the electric dust pan.

As can be seen by reference to the drawings, and in particularly to FIG. 1, the electric dust pan that forms the basis of the present invention is designated generally by the reference number 10. The electric dust pan 10 includes a housing 12 that incorporates a long rectangular shaped upper section 14 with a forward extension 16. The forward extension 16 includes a flat lower surface 18 and an upwardly and forwardly inclined lower surface 20 that terminates at an inlet opening 22. Extending from the rear of the housing 12 is an exhaust conduit 24 designed to mount to an interior residential or commercial (not shown) wall. Across the top of the housing 12 a hinged cover 26 featuring a series of clasps 22 which aid in providing an air tight seal for the interior of the housing 12. A handle 30 allows a user to easily grip the device while activating or deactivating it for use, while an indicator light 32 shows when the device 12 is in use. The interior of the electric dust pan 10 incorporates a high RPM motor 34 electrically coupled to a mercury switch 36.

The action of the motor 34 provides a vacuum source with a suction side communicating with the inlet opening 22 and discharge side communicating with an internal storage bag 38. The overall dimensions of the electric dust pan 10 measure approximately twelve inches in width and twenty-four inches in height. Power to the unit is supplied by a standard AC power cord 40 extending from the rear of the housing 12.

In use, a user installs the exhaust baffle and conduit assembly 24 of the electric dust pan 10 through his residential or commercial wall. The device is then attached by cord 40 to a convenient wall outlet. The user sweeps the floor in a standard manner, then tilts the housing 12 forward so that the inclined lower surface 20 contacts the floor. This trips the internal mercury switch 36 and activates the internal motor 34. As the motor 34 activates, it triggers the illumination of the mounted "in-use" light 32 to indicate the device is active. While active, the user sweeps the dirt and dust into the inlet opening 22 with a broom 50, allowing the device to suck all the dirt and dust upward and into the interior storage bag 38. The storage bag 38 may be removed and replaced when needed by opening the latches 28 along the hinged lid 26, raising the lid 26 and removing the bag 38 from inside.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. An electric dust pan, comprising:

a housing having an elongated rectangular upper section, and a forwardly extending lower section including an inlet opening and an upwardly and forwardly inclined bottom surface extending from a flat lower surface and terminating at the inlet opening;

an electric vacuum source disposed within the housing, the vacuum including a suction side and a discharge side, the suction side being disposed in communication with the inlet opening; and an electric mercury switch attached within the housing and being electrically coupled to the vacuum source, the mercury switch being disposed to activate the vacuum source when the housing is tilted forward from an upright position so that the inclined bottom surface of the lower section of the housing contacts a floor surface, and being disposed to deactivate the vacuum source when the housing is moved back to the upright position.

2. The electric dust pan of claim 1 further including a dust receiving bag disposed within the housing in communication with the discharge side of the vacuum source.

3. The electric dust pan of claim 2 further including an exhaust conduit extending out from a rear opening in the housing, the exhaust conduit being in communication with the discharge side of the vacuum source.

4. The electric dust pan of claim 3 wherein the housing includes a hinged top cover movable between an open position and a closed position, and clasps disposed to selectively hold the top cover in the closed position.

5. The electric dust pan of claim 4 wherein a handle is attached to the top cover, the handle being manipulated by a user to move the housing to the forward tilted position.

6. The electric dust pan of claim 5 wherein an indicator light is electrically coupled to the mercury switch and is activated when the housing is moved to the forward tilted position.

* * * * *